United States Patent [19]

Hoppe et al.

[11] Patent Number: 4,488,597

[45] Date of Patent: Dec. 18, 1984

[54] PUMP-DOWN STINGER ASSEMBLY METHOD AND APPARATUS

[75] Inventors: Joachim A. Hoppe, Spring; Ralph L. Simmons, Pearland, both of Tex.

[73] Assignee: Schlumberger Technology Corporation, Houston, Tex.

[21] Appl. No.: 310,830

[22] Filed: Oct. 13, 1981

[51] Int. Cl.[3] ..... E21B 47/00

[52] U.S. Cl. ..... 166/250; 166/297; 166/385; 166/55; 166/77.5

[58] Field of Search ..... 166/55, 250, 77, 75.5, 166/84, 85, 377, 378, 382, 385, 297, 383

[56] References Cited

U.S. PATENT DOCUMENTS

| | | | |
|---|---|---|---|
| 3,045,748 | 7/1962 | Schramm | 175/4.51 |
| 3,768,579 | 10/1973 | Klein | 173/164 |
| 3,807,502 | 4/1974 | Heilhecker et al. | 166/385 |
| 4,063,592 | 12/1977 | Youmans | 166/67 |
| 4,064,939 | 12/1977 | Marquis | 166/77 |
| 4,082,144 | 4/1978 | Marquis | 166/250 |
| 4,349,072 | 9/1982 | Escaron et al. | 166/383 |

OTHER PUBLICATIONS

"Ultrahigh-Angle Wells Are Technical and Economic Success", The Oil and Gas Journal, Jul. 19, 1976.

*Primary Examiner*—Stephen J. Novosad
*Assistant Examiner*—William P. Neuder

[57] ABSTRACT

A pump-down stinger assembly method for use with a well-logging tool or well bore perforator suspended from a well-logging cable utilizes a stinger adaptor which releasably attaches a length of well-logging cable to the lower end of the stinger adapter and allows the well-logging cable to be retrieved and pulled upwardly through a plurality of sections of stinger, or tubing.

40 Claims, 6 Drawing Figures

PUMP-DOWN STINGER ASSEMBLY METHOD AND APPARATUS

FIELD OF THE INVENTION

The invention relates to a pump-down stinger assembly method and apparatus for use with a well-logging cable in a borehole, particularly in deviated boreholes.

DESCRIPTION OF THE PRIOR ART

Many wells being drilled today in the search for oil and gas have portions of the borehole deviating from the usual vertical orientation thereof. Conditions, such as: shallow depth gas production; restrictions imposed by governmental agencies on the number of production platforms in certain areas; and exploration of reservoirs under shipping fairways, have resulted in boreholes including an increasing number of long, high deviation ramps, often above 70° angles of deviation and lengths up to 16,000 feet.

Conventional well-logging instruments, used to determine various physical parameters of formations adjacent the borehole, cannot rely upon gravitational forces to enable such well-logging instruments to traverse the borehole while suspended from a well-logging cable in a highly deviated borehole. Thus, it has previously been proposed to move conventional well-logging instruments, or tools, through a borehole by use of an extension member, or stinger, affixed to the well-logging instrument, whereby the well-logging tool can be pushed or pulled through the borehole via the rigid extension member. Additionally, the well-logging cable is protected from physical damage incurred by contact with the walls of the borehole.

One example of such an extension member is disclosed in U.S. Pat. No. 4,082,144, issued to Marquis on Apr. 4, 1978. This patent discloses an extension member which has a longitudinal slot along its entire length to allow a well-logging cable to be placed within the extension. A plurality of these extension members are connected in series via mating L-shaped extensions and female slots held in place by threaded split collars. The apparent disadvantages with this extension member are that each extension member requires precise machining operations to form the L-shaped extensions and female slots, as well as the longitudinal slot running the length of the extension member. Additionally, to avoid the excessive weight of such an extension member, additional manufacturing steps must be carried out to provide a lightweight collar disposed about the steel portion of such an extension member. The use of the collar to reduce the weight of the extension member thereby requires additional manufacturing steps to secure the collar to the extension member.

It has also been proposed to pass a well-logging cable through a plurality of extension members, or stingers, for use in well-logging operations in deviated boreholes; however, this approach has presented some problems. The assembly procedure is awkward, insofar as the well-logging cable must be passed through a plurality of tubular extensions and each extension member connected in turn to the previous extension member, or stinger. Additionally, upon removal of the plurality of extension members, or stingers, from the borehole, the well-logging cable must be cut into short sections and discarded as the stingers are removed from the borehole and disassembled. Thus, this approach to allow well-logging operations in deviated holes is inefficient and uneconomical.

It has also been proposed to route the well-logging cable on the exterior surface of a special tube, or stinger, which has a guard channel disposed on its exterior surface to releasably accommodate the well-logging cable to protect it from damage while in the borehole. An example of such a special tube is disclosed in commonly assigned U.S. Patent application Ser. No. 194,016, filed Oct. 6, 1980. Although, this special tube is a vast improvement over the previously described prior art, it still requires a special tubing, or stinger, which necessitates increased manufacturing costs.

Accordingly, prior to the development of the present invention, there has been no pump-down stinger assembly method and apparatus for use with well-logging cables in a borehole which: is simple and economical to use; provides easy assembly and disassembly without damage to the well-logging cable; and does not require specialized equipment. Therefore, the art has sought a pump-down stinger assembly method for use with well-logging cables in a borehole which provides ready assembly and disassembly without damage to the well-logging cable, is economical to use, and can use conventional, unmodified tubing.

SUMMARY OF THE INVENTION

In accordance with the invention the foregoing has been achieved through the present pump-down stinger assembly method and apparatus for use with a well-logging cable in a borehole. The present invention includes the steps of: lowering a well-logging tool and well-logging cable through a length of drill pipe disposed in the borehole; terminating the well-logging cable proximate the upper end of the borehole to provide a first length of well-logging cable; releasably attaching the first length of well-logging cable to a lower end of a length of stinger; lowering the length of stinger into the drill pipe; retrieving the first length of well-logging cable attached to the lower end of the stinger; raising the first length of well-logging cable through said stinger until the upper end of the first length of well-logging cable is disposed proximate the upper end of the borehole; and securing the upper end of the first length of well-logging cable to a second length of well-logging cable.

A feature of the present invention includes the steps of lowering at least a portion of the stinger and the well-logging tool through the drill pipe and into the borehole, attaching a locomotive to the stinger and pumping a fluid into the drill pipe into contact with the locomotive to cause the well-logging tool and at least a portion of the stinger to be lowered through the drill pipe into the borehole.

A further feature of the method of the present invention includes the steps of raising a portion of the well-logging tool into the lower end of the stinger and securing the portion of the well-logging tool to the stinger. An additional feature of the method of the present invention includes the step of providing the lower end of the stinger with a stinger adapter which allows the upper end of the well-logging tool to be latched into the lower end of the stinger. Another feature of the method of the present invention are the steps of: utilizing a spearhead on the upper end of the first length of well-logging cable; utilizing a spearhead overshot on the lower end of the second length of well-logging cable; and retrieving the first length of well-logging cable by lowering the second length of well-logging cable and spearhead overshot until the spearhead overshot engages the spearhead.

The stinger adapter of the present invention, for use with a length of stinger and a well-logging tool suspended from a well-logging cable in a borehole includes: a length of tubing having first and second ends; means for attaching the length of stinger to the first end of the tubing; means for securing a portion of the well-logging tool within the second end of the tubing; means for releasably securing the well-logging cable within the tubing; and means for positioning the tubing above the borehole, the positioning means being disposed on the outer surface of the tubing. A feature of the stinger adapter of the present invention resides in the fact that the means for securing the well-logging tool is an internal chamber formed in the second end of the tubing, the chamber having an entry passageway into the tubing disposed at the second end of the tubing. A further feature of the stinger adapter of the present invention is that the means for releasably securing the well-logging cable is a seating surface disposed within the tubing, intermediate the first and second ends of the tubing. The seating surface has an opening therein for allowing a portion of the well-logging cable to pass therethrough, the opening being smaller than the cross-sectional configuration of the second portion of said well-logging cable and the well-logging tool. An additional feature of the stinger adapter of the present invention is that the means for positioning the tubing is a radial groove formed in the outer surface of the tubing, disposed intermediate the first and second ends of the tubing; and a removable plate member for selective insertion into, and removal from, the groove.

The pump-down stinger assembly method and apparatus of the present invention may also be used in a cased borehole for use with production logging tools, radioactive logging tools, or with well bore perforators. The present invention includes the steps of lowering such a tool suspended from a well-logging cable through a length of drill pipe disposed in the cased borehole; terminating the well-logging cable proximate the upper end of the cased borehole to provide a first length of well-logging cable; releasably attaching the first length of well-logging cable to a lower end of a length of stinger; lowering the length of stinger into the length of drill pipe disposed in the based borehole; retrieving the first length of well-logging cable attached to the lower end of the stinger; raising the first length of well-logging cable through the stinger until the upper end of the first length of well-logging cable is disposed proximate the upper end of the cased borehole; and securing the upper end of the first length of well-logging cable to a second length of well-logging cable.

The pump-down stinger assembly method and apparatus of the present invention for use with a well-logging cable in a borehole, when compared with previously proposed prior art methods and apparatus has the advantages of: is efficient to assemble and disassemble; is economical to use; and does not require specialized tubing.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
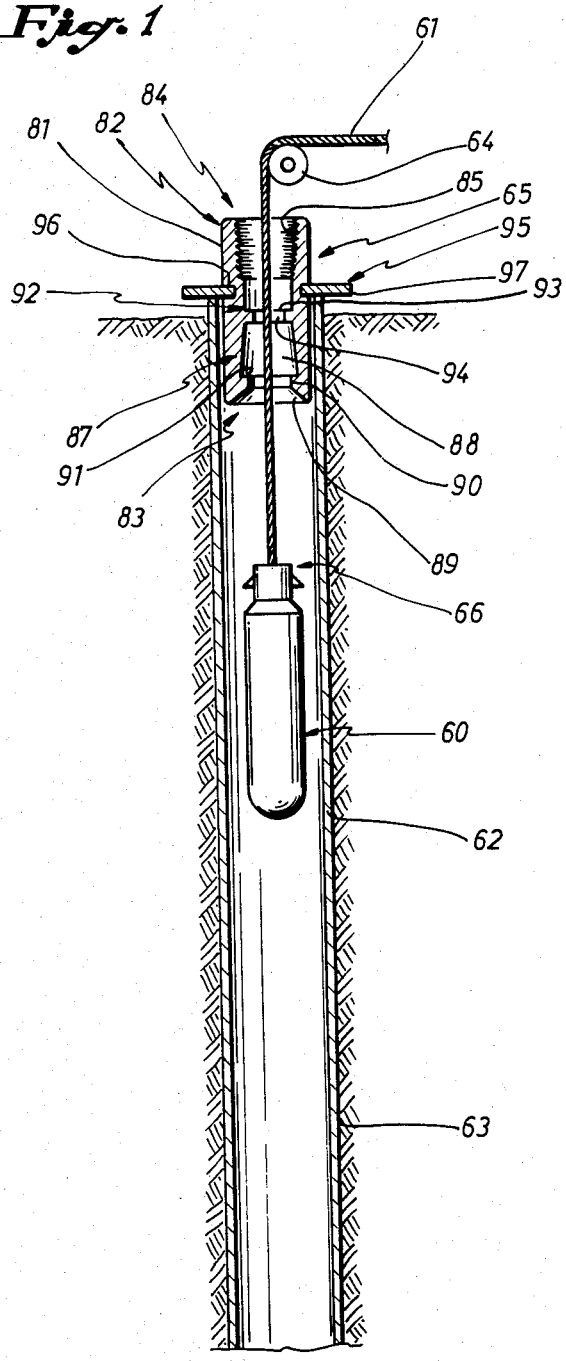
FIGS. 1–5 are partial cross-sectional views along the longitudinal axis of a borehole which sequentially illustrate the method and apparatus in accordance with the present invention.

In FIG. 1, a well-logging tool 60 is shown suspended from a well-logging cable 61 in a conventional drill pipe 62 located in borehole 63. Well-logging cable 61 passes over a sheave wheel 64, in a conventional manner, to allow the raising and lowering of well-logging cable 61 and well-logging tool 60. The sheave wheel 64 is suspended from a derrick or drilling rig (not shown) in a conventional manner. A stinger adapter 65, to be hereinafter described in greater detail, is temporarily disposed at the top of the length of drill pipe 62. Well-logging tool 60, which is of conventional design, also includes a latching device 66, or cable head, to be hereinafter described in greater detail, which is disposed at the top of well-logging tool 60. Borehole 63 may be a deviated borehole (not shown), but for the sake of drawing clarity is shown as a non-deviated borehole. Further, for the sake of drawing clarity, the conventional annular space between borehole 63 and the outer surface of drill pipe 62 is not shown.

With reference to FIGS. 1–5, the pump-down stinger assembly method of the present invention will be described. As shown in FIG. 1, the well-logging tool 60 and well-logging cable 61 are lowered through a length of drill pipe 62 into borehole 63. Prior to lowering well-logging tool 60 and well-logging cable 61, stinger adapter 65 is temporarily secured to the top of drill pipe 62, in a manner to be hereinafter described. Thus, it should be noted that well-logging cable 61 may be preferably passed through stinger adapter 65 and connected to well-logging tool 60 prior to stinger adapter 65 being temporarily secured to the top of drill pipe 62. Alternatively, a small diameter well-logging tool may be utilized, such that it can pass through stinger adapter 65.

Figure 2:
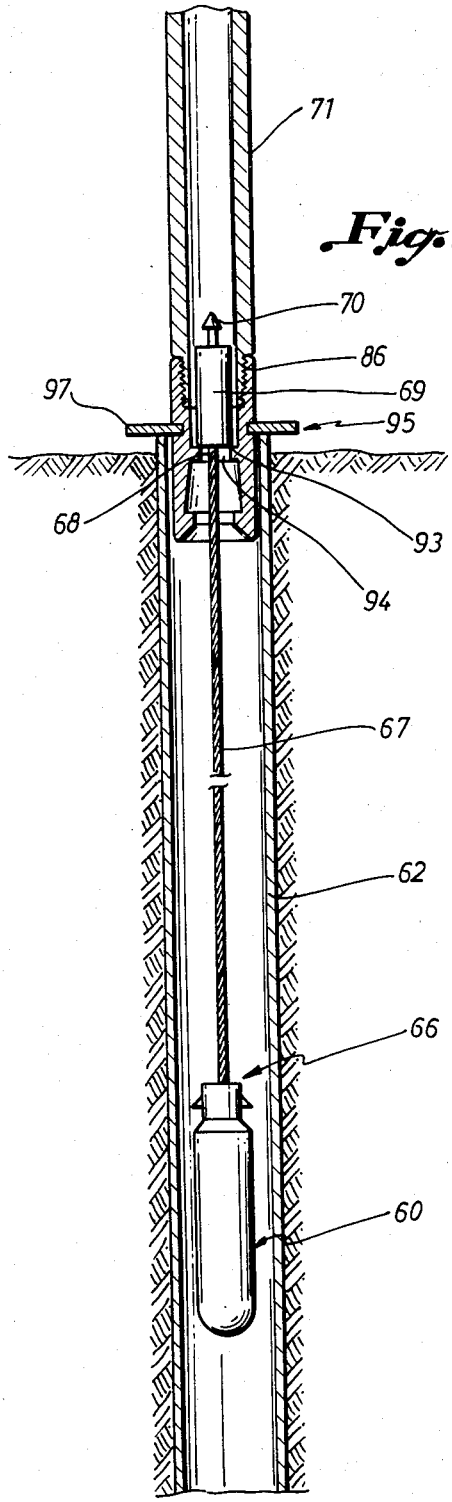

With reference to FIG. 2, it is seen that well-logging tool 60 is lowered into drill pipe 62 a distance which is preferably approximately 1,000 feet. Well-logging cable 61 is then terminated, or cut, proximate the upper end of borehole 63 at a point proximate the stinger adapter 65 to provide a first length 67 of well-logging cable 61. The first length 67 of well-logging cable 61 is releasably attached to a lower end of a length of stinger, or tubing, by providing the upper end 68 of the first length 67 of well-logging cable 61 with a conventional torpedo 69 and spearhead 70, whereby the seating of torpedo 69 within stinger adapter 65 releasably attaches the first length 67 of well-logging cable 61 to stinger adapter 65.

Figure 3:
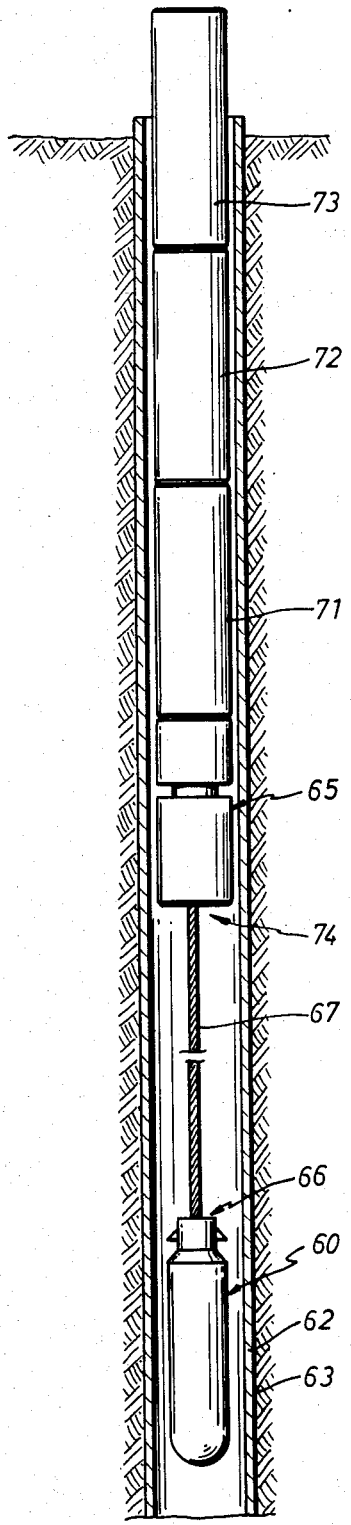

As shown in FIG. 2 a length of stinger 71, or tubing, is then secured to stinger adapter 65, as by threadedly securing at least one length of stinger 71 to stinger adapter 65. As shown in FIG. 3, there are a plurality of lengths of stinger 71, 72, and 73 utilized in conjunction with stinger adapter 65, whereby it may be seen that stinger adapter 65 forms the lower end 74 of the length of stinger 71.

After the first length of stinger 71 has been secured to stinger adapter 65, the stinger adapter 65 is released from the top of drill pipe 62, as will be hereinafter described in greater detail. With reference to FIGS. 2 and 3, it is seen that the length of stinger 71, including lengths of stinger 72 and 73 and stinger adapter 65, are lowered into the drill pipe 62. As many lengths of stinger 71–73 are connected in order to provide an integral stinger of the desired length. These sections of stinger 71–73 are connected via conventional threaded connections.

Figure 4:
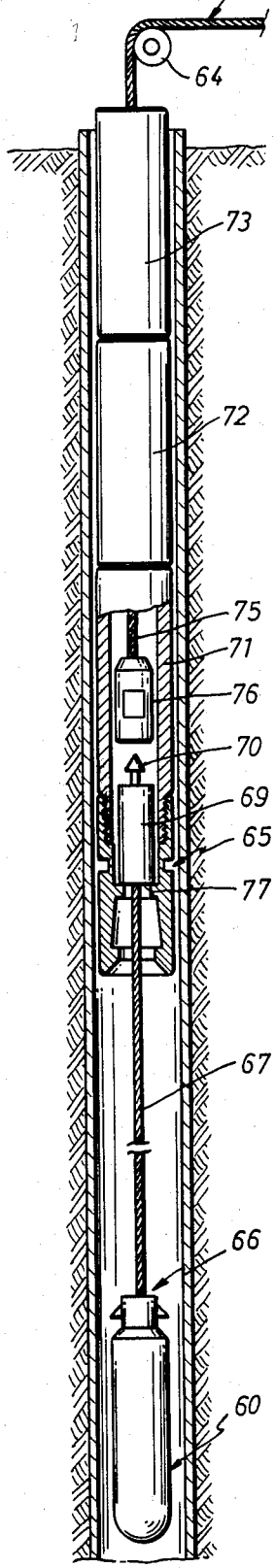

With reference to FIGS. 3 and 4, it should be noted as the stinger lengths 71–73 and stinger adapter 65 are lowered into the drill pipe 62, the well-logging tool 60 will remain suspended from the lower end 74 of stinger 71, or the lower end of stinger adapter 65, via the first length 67 of well-logging cable 61. That length 67 of cable 61 is releasably attached to the stinger adapter 65 by the seating of torpedo 69 within stinger adapter 65 as shown in FIG. 2. Upon the desired length of stinger sections 71–73 being lowered into drill pipe 62, stinger lengths 71–73 may be secured in the position shown in FIG. 3 as by any suitable clamping device disposed at the earth's surface.

With well-logging tool 60, stinger lengths 71–73, and stinger adapter 65 in the position shown in FIG. 3, the next step of the method in accordance with the present invention is to retrieve the first length 67 of well-logging cable 61 which is releasably attached to the lower end 74 of stinger 71, or stinger adapter 65. As shown in FIG. 4 the first length 67 of well-logging cable 61 is retrieved by lowering a second length 75 of well-logging cable 61' through stinger sections 71–73 as shown in FIG. 4. The second length 75 of well-logging cable 61' has a spearhead overshot 76 on its lower end which upon being lowered engages spearhead 70, whereby well-logging tool 60 is suspended by both the first and second lengths 67 and 75 of the well-logging cable 61 and 61'.

After spearhead overshot 76 engages spearhead 70, the first length 67 of well-logging cable 61, as well as the second length 75 of well-logging cable 61', are raised through the stinger lengths 71–73 until the upper end 77 of the first length 67 of well-logging cable 61 is disposed proximate the upper end of borehole 63. Now spearhead overshot 76 and spearhead 70 are accessible to workmen at the earth's surface. Spearhead overshot 76 and spearhead 70 may then be disconnected from the first and second lengths 67 and 75 of the well-logging cable 61 and 61'. After removal of spearhead overshot 76 and spearhead 70 from the first and second lengths 67 and 75 of well-logging cable 61 and 61', the upper end 77 of the first length 67 of well-logging cable 61 is secured to the second length 75 of well-logging cable 61' in any conventional manner, so that electrical signals can pass through the first and second lengths 67 and 75 of well-logging cable 61 and 61' to well-logging tool 60.

Figure 5:
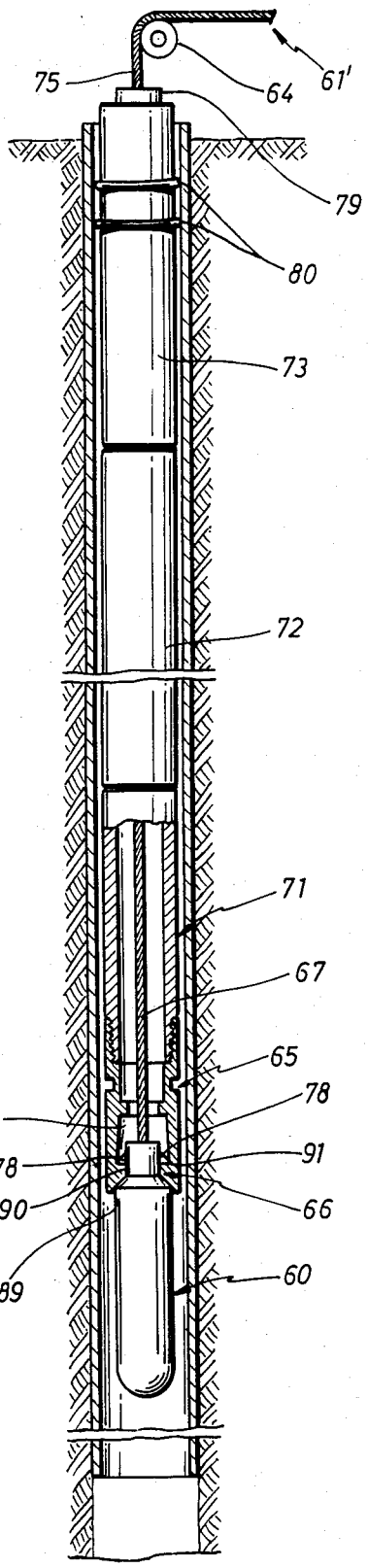

As shown in FIG. 5, a portion of well-logging tool 60 is raised into the lower end of the stinger 71, or preferably into stinger adapter 65. The portion of well-logging tool 60 which is raised into stinger adapter 65 preferably is the latching device 66, or cable head, of well-logging tool 60. Well-logging tool 60 may be raised into stinger adapter 65 either: via first and second lengths 67 and 75 of the well-logging cable 61 and 61', along with spearhead overshot 76 and spearhead 70; or via first and second lengths 67 and 75 of well-logging cable 61 and 61' after spearhead overshot 76 and spearhead 70 have been removed and first and second lengths 67 and 75 of the well-logging cable 61 and 61' have been spliced together.

As well-logging tool 60, including the latching device 66, or cable head, is raised into stinger adapter 65, the well-logging tool 60 is secured within stinger adapter 65 through the operation of the latching device 66. Latching device 66 is provided with a plurality of wedge members 78 which cooperate with stinger adapter 65. As the latching device 66 is pulled upwardly into stinger adapter 65, wedge members 78 are forced inwardly until the configuration of stinger adapter 65 allows such wedge members 78 to move outwardly to secure the well-logging tool 60, via latching device 66, within stinger adapter 65. Wedge members 78 may preferably be outwardly biased by means of suitable springs; however, of course, any suitable biasing means could be utilized, such as small hydraulic pistons.

Still with reference to FIG. 5, after at least a portion of the well-logging tool 60 is secured within stinger adapter 65, a clamp 79 is mounted on the well-logging cable 75 and stinger 73. The weight of the well-logging tool 60, stinger adapter 65, and stingers 71–73 is thus supported by the second length 75 of well-logging cable 61' and clamp 79. Without clamp 79, the weight of the well-logging tool 60, stinger adapter 65 and stingers 71–73 would be supported by well-logging cable 67 at its connection to latching device 66, or cable head. As will be hereinafter described in greater detail, it is preferable to have the foregoing components supported by clamp 79 and the well-logging cable 75, rather than by the first length 67 of well-logging cable 61 at the latching device 66.

Still with reference to FIG. 5, after clamp 79 has been applied to stinger 73, at least a portion of the overall stinger 71–73 and well-logging tool 60 may be lowered through and beyond the end of drill pipe 62 into the borehole 63, so that conventional well-logging operations may be conducted in the borehole. Preferably, the stinger 71–73 and well-logging tool 60 are lowered by attaching a conventional locomotive 80 to one of the stinger sections 71–73, preferably the upper length 73 of the stinger. A fluid is then pumped into the drill pipe 62 and into the annular space between stinger 73 and drill pipe 62, and thus into contact with the locomotive 80. The force of the fluid, preferably conventional drilling mud, upon the locomotive 80 causes at least a portion of the stinger 71–73 and well-logging tool 60 to be lowered through the drill pipe 62 into the borehole 63. Locomotive 80 is preferably a conventional rubber cup locomotive. A conventional no-go nipple (not shown) may be provided on stinger 71–73 to prevent it from completely exiting from drill pipe 62.

After the completion of the desired well-logging operations in borehole 63, the upper end of the stinger 71–73 is raised through drill pipe 62 to a position proximate the upper end of the borehole 63 as shown in FIG. 5 by raising well-logging cable 61'. A portion of the second length 75 of the well-logging cable 61' disposed above the upper end of the borehole 63 is then disassociated from the well-logging tool 60 to allow the stinger 71–73 and well-logging tool 60 to be raised and removed from the borehole 63 and drill pipe 62. Well-logging cable 75 may be merely cut at a position above clamp 79 to disassociate it from well-logging tool 60; however, it is desirable to remove the entire first and second lengths 67 and 75 of the well-logging cable 61 and 61' from within stinger 71–73, prior to the removal of the stinger 71–73 and well-logging tool 60 from the borehole 63 and drill pipe 62.

The removal of the entire length of the well-logging cables 67 and 75 from stinger 71–73 and disassociation from well-logging tool 60 is accomplished in the following manner. A conventional weak-point is associated with well-logging tool 60. This conventional weak-point, upon the exertion of a predetermined force, breaks and separates the connection between the first length 67 of well-logging cable 61 and well-logging tool 60. This conventional weak-point may be disposed within the latching device 66, or cable head. Thus, after the upper end of stinger 73 is disposed in the position shown in FIG. 5, proximate the upper end of borehole 63, clamp 79 is accessible to workmen at the earth's surface. Clamp 79 is disconnected from the second length 75 of the well-logging cable 61'. Stinger 73 is then secured by any suitable, conventional device to prevent any movement of well-logging tool 60 and stinger 71–73. The second length 75 of the well-logging cable 61' is then pulled upwardly until the predetermined force of the weak-point associated with well-logging tool 60 is achieved. Upon exceeding the predetermined force of the weak-point associated with well-logging tool 60, the connection between the first length 67 of the well-logging cable 61 and the well-logging tool 60 is broken. The first and second lengths 67 and 75 of the well-logging cable 61 and 61' may then be raised upwardly and removed from stinger 71–73, leaving the well-logging tool 60 secured within stinger adapter 65 via wedge members 78 of the latching device 66. After the well-logging cable 67 and 75 is removed from the lengths of stinger 71–73, they may be raised out of the drill pipe 62 and borehole 63. The various sections 71–73 of the stinger are disassembled as their threaded connections are raised to a position disposed above the drill pipe 62 and borehole 63. The stinger adapter 65 with well-logging tool 60 secured therein is likewise disconnected from the length of stinger 71 and well-logging tool 60 is removed from the stinger adapter 65. Now any other desired operations, such as further drilling may be conducted in borehole 63, and the well-logging tool 60 and stinger 71–73 and stinger adapter 65 can be transported to another well location.

Referring again to FIGS. 1 and 2, the stinger adapter 65 of the present invention will be described in greater detail. Stinger adapter 65 generally comprises a length of tubing 81 having first and second ends 82 and 83. Disposed at the first end 82 of tubing 81 is a means for attaching 84 a length of stinger, such as stinger length 71 to the first end 82 of the tubing 81. Preferably, the means for attaching is a plurality of screw threads 85 disposed at the first end 82 of tubing 81 and screw threads 85 cooperate with mating screw threads 86 on the length of stinger 71. Although screw threads 85 could be mounted on the exterior of tubing 81, they are disposed on the interior surface of tubing 81. As is shown in FIGS. 1 and 2, tubing 81 has substantially the same outer cross-sectional configuration and size as the length of stinger 71.

Stinger adapter 65 also has a means for securing 87 a portion of well-logging tool 60 within the second end 83 of tubing 81. The means for securing 87 well-logging tool 60 is an internal chamber 88 formed in the second end 83 of tubing 81, and the chamber 88 has an entry passageway 89 into tubing 81 disposed at the second end 83 of the tubing. Entry passageway 89 flares inwardly toward chamber 88 and has a reduced neck portion 90 adjacent chamber 88, as shown in FIGS. 1 and 2. As seen in FIG. 5, inwardly flaring passageway 89 cooperates to inwardly depress the wedge members 78 as well-logging tool 60 and as the latching device 66 are raised into stinger adapter 65. Additionally, as shown in FIG. 5, after wedge members 78 have moved upwardly and past the reduced neck portion 90 of entry passageway 89, wedge members 78 move outwardly to engage the lower wall surface 91 of chamber 88 to secure at least a portion of well-logging tool 60 within stinger adapter 65.

With reference to FIGS. 1 and 2, it is seen that stinger adapter 65 also has a means for releasably securing 92 well-logging cable 61 within tubing 81. Preferably the means for releasably securing 92 the well-logging cable 61 is a seating surface 93 disposed within tubing 81 intermediate the first and second ends 82 and 83 of tubing 81. Seating surface 93 has an opening 94 for allowing a portion of well-logging cable 61 to pass therethrough. The opening is smaller in diameter than the cross-sectional configuration of a second portion of the well-logging cable 61, or torpedo 69, which is attached to well-logging cable 61 as shown in FIG. 2. With reference to FIG. 2, it is seen that the lower end of torpedo 69 seats against seating surface 93, thus releasably securing well-logging cable 61 within tubing 81.

Figure 6:
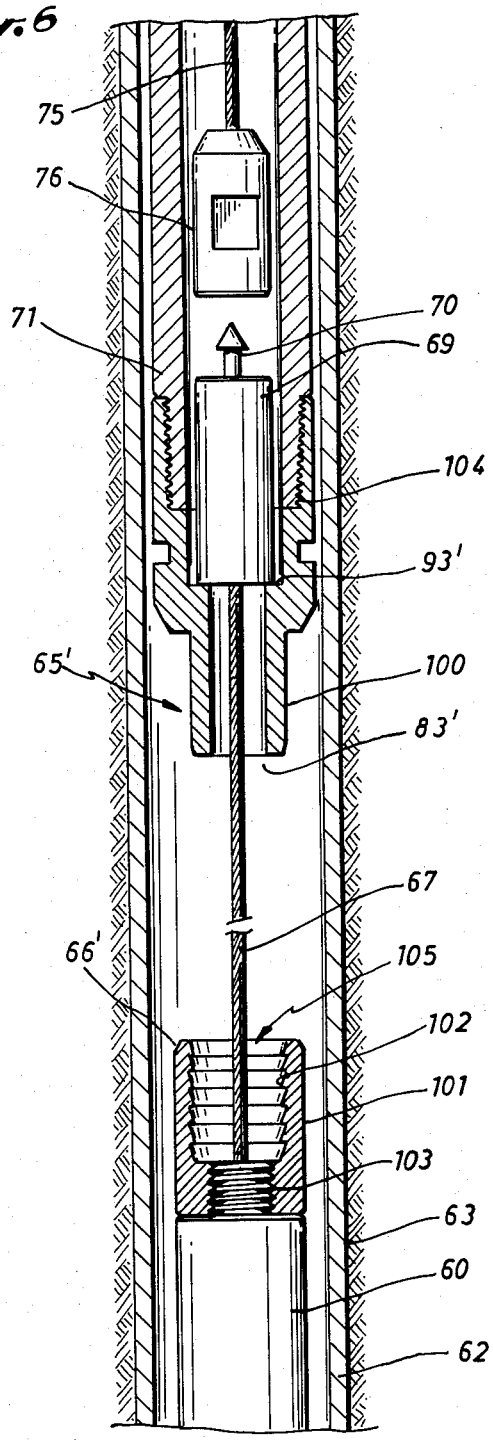
FIG. 6 is a partial cross-sectional view along the longitudinal axis of a borehole illustrating another embodiment of a stinger adapter in accordance with the present invention.

As illustrated in FIG. 6, another means for securing a portion of the well-logging tool 60 may be provided with the second end 83' of tubing 100. The latching device 66' is attached to tool 60 and comprises a grapple 101 having energizing barbs 102 about the internal circumference of the grapple 105. Grapple 101 may be secured to logging tool 60 as by threads 103. The logging tool may be connected to the first length 67 of logging cable 61 by conventional means.

Stinger/grapple adapter 65' may be attached to stinger tubing 71 by means of threads 104. A seating surface 93' is provided where torpedo 69 may seat as the stinger/grapple adapter 65' is lowered into the borehole. Hollow tubing 100 forms part of adapter 65' and has an outside diameter compatible with the diameter of the barbs 102 of grapple 101. The internal diameter of tube 100 is sufficiently large to allow the first length 67 of logging cable 67 to easily pass through.

As logging tool 60 is pulled up as by pulling fishing spear 70, the energizing barbs 102 engage the exterior of tubing 100 thereby preventing logging tool 60 from moving in a downward direction with respect to the tube 100 and stinger 71. After grapple 101 is fully pulled up and around tube 100, logging tool 60 is secured to the adapter 65'.

Again with reference to FIGS. 1 and 2, stinger adapter 65 has a means for positioning 95 the tubing 81 above borehole 63, and this means for positioning 95 is disposed on the outer surface of tubing 81. Preferably the means for positioning 95 the tubing 81 is a radial groove 96 formed in the outer surface of tubing 81 and disposed intermediate the first and second ends 82 and 83 of tubing 81. A removable plate member 97 is provided for selective insertion into, and removal from, groove 96. When plate member 97 is inserted into groove 96, stinger adapter 65 is supported by plate member 97 which rests upon the top of drill pipe 62. Plate member 97 may be of any suitable configuration, such as a U-shaped plate or two plate members with semicircular openings which mate with groove 96.

Although the description of the pump-down stinger assembly method and stringer adapter of the present invention have been described in conjunction with a well-logging tool, it should be readily apparent to those skilled in the art that the method and apparatus of the present invention can also be used with a conventional well bore perforator, a production logging tool, or a radioactive tool which measures through the casing, in lieu of the well-logging tool 60. Since such tools are normally used in cased boreholes, the only difference between the method and apparatus described in connection with FIGS. 1–5 and the use of the pump-down stinger assembly method of the present invention with such tools is that a steel casing would be present lining borehole 63. Additionally, a well bore perforator, or other tool, would be substituted for well-logging tool 60. Thus, the pump-down stinger method of the present invention, for use with a well bore perforator, or other tool, suspended from a well-logging cable in a cased borehole would comprise the steps of: lowering the well bore perforator, or other tool, and well-logging cable through the cased borehole; the well-logging cable 61 would be terminated proximate the upper end of the cased borehole to provide a first length 67 of well-logging cable; the first length 67 of well-logging cable 61 would be releasably attached to a lower end of a length of stinger 71, via stinger adapter 65; the length of stinger 71 would be lowered into the cased borehole; the first length 67 of well-logging cable 61 attached to the lower end of stinger 71 would be retrieved as shown in FIG. 4; the first length 67 of well-logging cable 61 would be raised through the stinger 71–73 until the upper end of the first length 67 of well-logging cable 61 is disposed proximate the upper end of the case borehole as shown in FIG. 5; and the upper end of the first length 67 of well-logging cable 61 would be secured to a second length of well-logging cable 75, also as shown in FIG. 5.

The other steps previously described in connection with a well-logging tool 60 would likewise be carried out as previously described in connection with FIGS. 1–5 for use with a well-logging tool 60. The only exception is that instead of performing well-logging operations in the open borehole 63, the well bore perforator, or other tool, would be utilized to perforate the casing, or perform other functions, in the cased borehole.

It is to be understood that the invention is not limited to the exact details of construction, operation, exact materials or embodiments shown and described, as obvious modifications and equivalents will be apparent to one skilled in the art; for example, spring biased latching means could be incorporated into the chamber of the stinger adapter to cooperate with the cable head of the well-logging tool or well bore perforator. Accordingly, the invention is therefore to be limited only by the scope of the appended claims.

We claim:

1. A pump-down stinger assembly method for use with a well-logging tool suspended from a well-logging cable in a borehole, comprising:

lowering the well-logging tool and well-logging cable through a length of drill pipe disposed in the borehole;

terminating the well-logging cable proximate the upper end of the borehole to provide a first length of well-logging cable;

releasably attaching the first length of well-logging cable to a lower end of a length of stinger;

lowering the length of stinger into said drill pipe;

retrieving the first length of well-logging cable attached to the lower end of the stinger;

raising the first length of well-logging cable through said stinger until the upper end of the first length of well-logging cable is disposed proximate the upper end of the borehole; and securing the upper end of the first length of well-logging cable to a second length of well-logging cable.

2. The method of claim 1, including the step of lowering at least a portion of said stinger and said well-logging tool through the drill pipe and into the borehole.

3. The method of claim 2, including the step of attaching a locomotive to said stinger and pumping a fluid into the drill pipe into contact with the locomotive to cause at least a portion of the stinger and the well-logging tool to be lowered through said drill pipe into the borehole.

4. The method of claim 2, further including the steps of raising the upper end of the stinger through the drill pipe and proximate the upper end of the borehole, disassociating the portion of the well-logging cable disposed above the upper end of the borehole from the well-logging tool, and removing the stinger and well-logging tool from the borehole.

5. The method of claim 4, wherein the well-logging cable is disassociated from the well-logging tool by breaking a weak-point associated with the well-logging tool, whereby the well-logging cable may be removed from the stringer by raising the well-logging cable through the stinger.

6. The method of claim 1 including the steps of raising at least a portion of said well-logging tool into the lower end of the stinger and securing said portion of the well-logging tool to said stinger.

7. The method of claim 6 wherein the upper end of said well-logging tool is raised and latched into the lower end of the stinger.

8. The method of claim 7, including the step of providing the lower end of the stinger with a stinger adapter which allows the upper end of the well-logging tool to be latched into the lower end of the stinger.

9. The method of claim 1, including the step of placing a spearhead and torpedo on the upper end of the first length of well-logging cable after the well-logging cable is terminated proximate the upper end of the borehole.

10. The method of claim 9, including the steps of utilizing a stinger adapter at the lower end of the stinger; and the upper end of the first length of well-logging cable is releasably attached to the stinger adapter by the seating of the torpedo within the stinger adapter.

11. The method of claim 1 including th steps of utilizing a spearhead on the upper end of the first length of well-logging cable; utilizing a spearhead overshot on the lower end of the second length of well-logging cable; and retrieving the first length of well-logging cable by lowering the second length of well-logging cable and spearhead overshot until the spearhead overshot engages the spearhead.

12. A pump-down stinger assembly method for use with a well-logging tool suspended from a well-logging cable in a borehole, comprising:

securing a stinger adapter to the top of a length of drill pipe disposed in the borehole;

lowering well-logging cable through the stinger adapter and the well-logging tool into the length of drill pipe disposed in the borehole;

terminating the well-logging cable proximate the stinger adapter to provide a first length of well-logging cable;

releasably attaching the first length of well-logging cable to the stinger adapter;

securing at least one length of stinger to the stinger adapter;

releasing the stinger adapter from the drill pipe;

lowering the length of stinger and stinger adapter into said drill pipe;

retrieving the first length of well-logging cable attached to the stinger adaptor;

raising the first length of well-logging cable through said stinger until the upper end of the first length of well-logging cable is disposed proximate the upper end of the borehole; and securing the upper end of the first length of well-logging cable to a second length of well-logging cable.

13. The method of claim 12, including the steps of lowering at least a portion of said stinger and said well-logging tool through the drill pipe and into the borehole.

14. The method of claim 13, including the step of attaching a locomotive to said stinger and pumping a fluid into the drill pipe into contact with the locomotive to cause at least a portion of the stinger and the well-logging tool to be lowered through said drill pipe into the borehole.

15. The method of claim 13, further including the steps of raising the upper end of the stinger through the drill pipe and proximate the upper end of the borehole, disassociating the portion of the well-logging cable disposed above the upper end of the borehole from the well-logging tool, and removing the stinger and well-logging tool from the borehole.

16. The method of claim 15, wherein the well-logging cable is disassociated from the well-logging tool by breaking a weak-point associated with the well-logging tool, whereby the well-logging cable may be removed from the stinger by raising the well-logging cable through the stinger.

17. The method of claim 12 including the steps of raising at least a portion of said well-logging tool into the the stinger adapter and securing said portion of the well-logging tool to said stinger adapter.

18. The method of claim 17 wherein the upper end of said well-logging tool is raised and latched into the lower end of the stinger adapter.

19. The method of claim 12, including the step of placing a spearhead and torpedo on the upper end of the first length of well-logging cable after the well-logging cable is terminated proximate the stinger adapter.

20. The method of claim 19, wherein the upper end of the first length of well-logging cable is releasably attached to the stinger adapter by the seating of the torpedo within the stinger adapter.

21. The method of claim 12 including the steps of utilizing a spearhead on the upper end of the first length of well-logging cable; utilizing a spearhead overshot on the lower end of the second length of well-logging cable; and retrieving the first length of well-logging cable by lowering the second length of well-logging cable and spearhead overshot until the spearhead overshot engages the spearhead.

22. A pump-down stinger assembly method for use with a well bore perforator suspended from a well-logging cable in a cased borehole, comprising:

lowering the well bore perforator and well-logging cable through a length of drill pipe disposed in the cased borehole;

terminating the well-logging cable proximate the upper end of the cased borehole to provide a first length of well-logging cable;

releasably attaching the first length of well-logging cable to a lower end of a length of stinger;

lowering the length of stinger into said length of drill pipe disposed in the cased borehole;

retrieving the first length of well-logging cable attached to the lower end of the stinger;

raising the first length of well-logging cable through said stinger until the upper end of the first length of well-logging cable is disposed proximate the upper end of the cased borehole; and securing the upper end of the first length of well-logging cable to a second length of well-logging cable.

23. The method of claim 22, including the steps of lowering at least a portion of said stinger and said well bore perforator through the length of drill pipe and into the cased borehole whereby a desired portion of said borehole is perforated.

24. The method of claim 23, including the step of attaching a locomotive to said stinger and pumping a fluid into the length of drill pipe disposed in the cased borehole and into contact with the locomotive to cause at least a portion of the stinger and the well bore perforator to be lowered through the length of drill pipe.

25. The method of claim 23, further including the steps of raising the upper end of the stinger through the cased borehole and proximate the upper end of the length of drill pipe disposed in the borehole, disassociating the portion of the well-logging cable disposed above the upper end of the borehole from the well bore perforator, and removing the stinger and well bore perforator from the length of drill pipe disposed in the borehole.

26. The method of claim 25, wherein the well-logging cable is disassociated from the well bore perforator by breaking a weak-point associated with the well bore perforator, whereby the well-logging cable may be removed from the stinger by raising the well-logging cable through the stringer.

27. The method of claim 22 including the steps of raising at least a portion of said well bore perforator into the lower end of the stinger and securing said portion of the well bore perforator to said stinger.

28. The method of claim 27 wherein the upper end of said well bore perforator is raised and latched into the lower end of the stinger.

29. The method of claim 28, including the step of providing the lower end of the stinger with a stinger adapter which allows the upper end of the well bore perforator to be latched into the lower end of the stinger.

30. The method of claim 22, including the step of placing a spearhead and torpedo on the upper end of the first length of well-logging cable after the well-logging cable is terminated proximate the upper end of the cased borehole.

31. The method of claim 30, including the steps of utilizing a stinger adapter at the lower end of the stinger; and the upper end of the first length of well-logging cable is releasably attached to the stinger adapter by the seating of the torpedo within the stinger adapter.

32. The method of claim 22 including the steps of utilizing a spearhead on the upper end of the first length of well-logging cable; utilizing a spearhead overshot on the lower end of the second length of well-logging cable; and retrieving the first length of well-logging cable by lowering the second length of well-logging cable and spearhead overshot until the spearhead overshot engages the spearhead.

33. A stinger adapter assembly for use with a length of stinger and a well-logging tool in a borehole, comprising:

a length of tubing having first and second ends;

means for attaching the length of stinger to said first end of the tubing;

means for securing at least a portion of the well-logging tool within the second end of said tubing;

a length of well-logging cable for suspending the well-logging tool from one end thereof;

retainer means attached to the other end of said length of cable;

a seating surface formed on the inner surface of said tubing intermediate said first and second ends, said surface defining an opening allowing said length of cable to pass therethrough and being engageable by said retainer means to retain it and allow the well-logging tool to be suspended from said tubing through said length of cable;

means for retaining a portion of said well-logging cable within said tubing thus allowing the well-logging tool to be suspended from said tubing cable;

means for positioning the tubing above the borehole, said positioning means being disposed on the outer surface of said tubing.

34. The assembly of claim 33, wherein the means for attaching is a plurality of screw threads disposed at the first end of said tubing for cooperation with mating screw threads on said length of stinger.

35. The stinger adapter of claim 34, wherein said screw threads are disposed on the interior surface of said tubing.

36. The assembly of claim 33, wherein the tubing has substantially the same outer cross-sectional configuration and size as the length of stinger.

37. The assembly of claim 33, wherein the means for securing the well-logging tool is an internal chamber formed in the second end of the tubing, said chamber having an entry passageway into said tubing disposed at the second end of said tubing.

38. The stinger adapter of claim 37 wherein said entry passageway flares inwardly toward said chamber and has a reduced neck portion adjacent said chamber.

39. The assembly of claim 33, wherein the means for securing the well-logging tool is a tube having an outside diameter compatible with the diameter of barbs of a grapple attached to the well-logging tool.

40. The assembly of claim 33 wherein the means for positioning the tubing is a circumferential groove formed in the outer surface of said tubing and disposed intermediate said first and second ends of said tubing, and a removable plate member for selective insertion into, and removal from, said groove.

* * * * *